US005507431A

United States Patent [19]

Bertone

[11] Patent Number: 5,507,431

[45] Date of Patent: Apr. 16, 1996

[54] CLOSURE CLASP FOR A GABLE-TOPPED FOOD CARTON

[76] Inventor: Anthony Bertone, 35 Century Trail, Harrison, N.Y. 10528

[21] Appl. No.: 365,935

[22] Filed: Dec. 29, 1994

[51] Int. Cl.[6] ..... B65D 5/42

[52] U.S. Cl. ..... 229/125.39; 24/30.5 R; 229/125.42; 229/160.2

[58] Field of Search ..... 229/125.04, 125.12, 229/125.13, 125.37, 125.39, 125.42, 160.2; 24/30.5 R, 30.5 L; 383/69

[56] References Cited

U.S. PATENT DOCUMENTS

| | | | |
|---|---|---|---|
| 899,612 | 9/1908 | Phillips | 24/30.5 R |
| T983,001 | 6/1979 | Coffey | 24/30.5 R |
| 1,459,735 | 6/1923 | Kraft | 24/30.5 R |
| 1,488,864 | 4/1924 | Canaday | 24/30.5 R |
| 1,961,382 | 6/1934 | Nunes | 229/125.12 |
| 3,217,967 | 11/1965 | Jackson | 383/69 |
| 3,463,380 | 8/1969 | Cooperstein | 229/125.42 |
| 3,629,905 | 12/1971 | Cote | 24/30.5 R |
| 4,109,351 | 8/1978 | Coffey | 229/125.42 |
| 4,619,398 | 10/1986 | Laramie | 229/125.12 |
| 4,979,668 | 12/1990 | Allen et al. | 229/125.12 |

FOREIGN PATENT DOCUMENTS

| | | | |
|---|---|---|---|
| 156779 | 10/1985 | European Pat. Off. | 24/30.5 R |
| 9316930 | 9/1993 | WIPO | 24/30.5 R |

*Primary Examiner*—Gary E. Elkins
*Attorney, Agent, or Firm*—Martin J. Spellman, Jr.

[57] ABSTRACT

A gable top food container provided with a plastic closure device to facilitate opening and reclosure of the folded pour spout. Strips of polyethylene are adhered to the outer spout folds along the top ridge of the container by adhesive or heat sealing. Outer ends of the two strips have cooperating aperture and tongue structures to releasably hold the ends together. The strips facilitate the initial unsealing of and opening of the container and permit it to be effectively resealed after each usage.

4 Claims, 5 Drawing Sheets

FIG.5
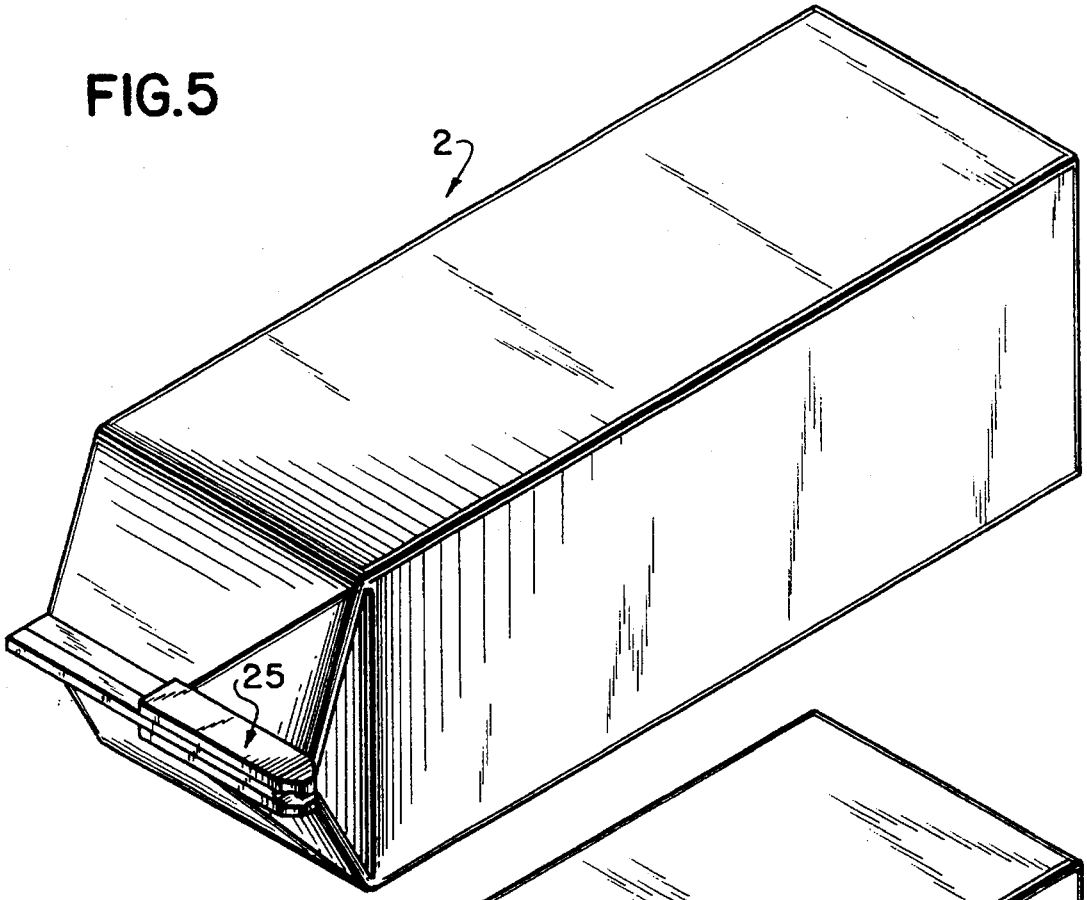
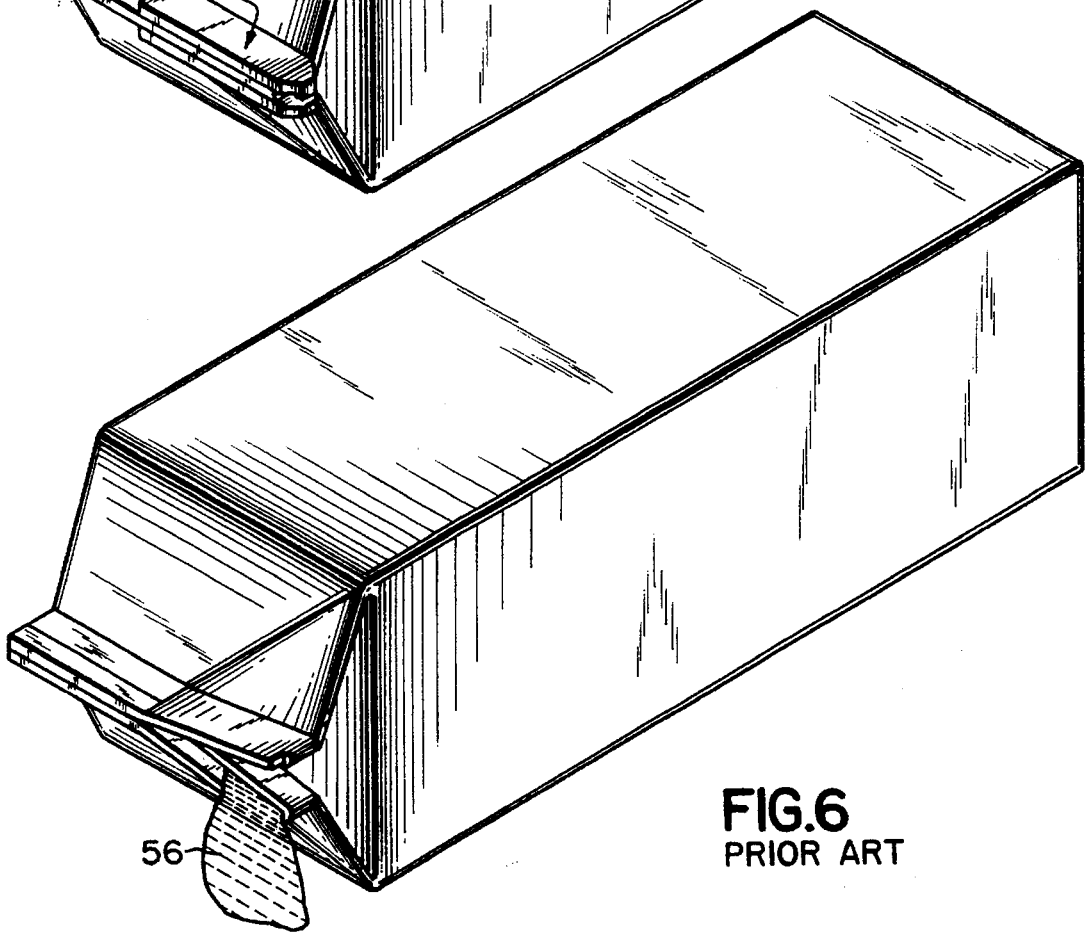
FIG.6
PRIOR ART

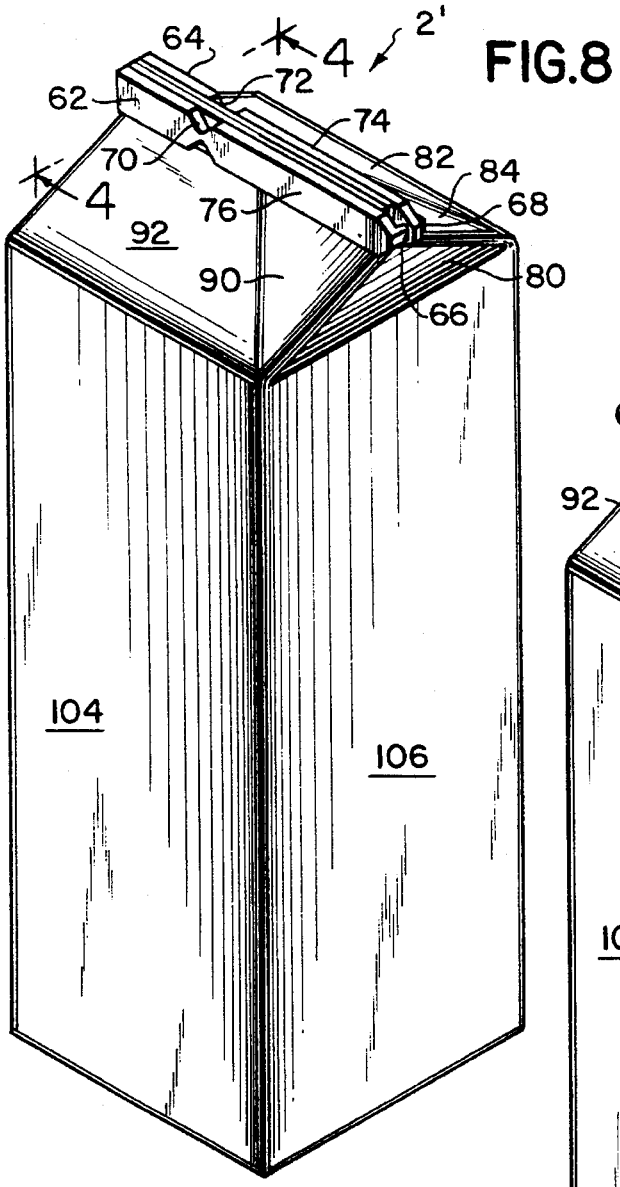
FIG.8
FIG.9
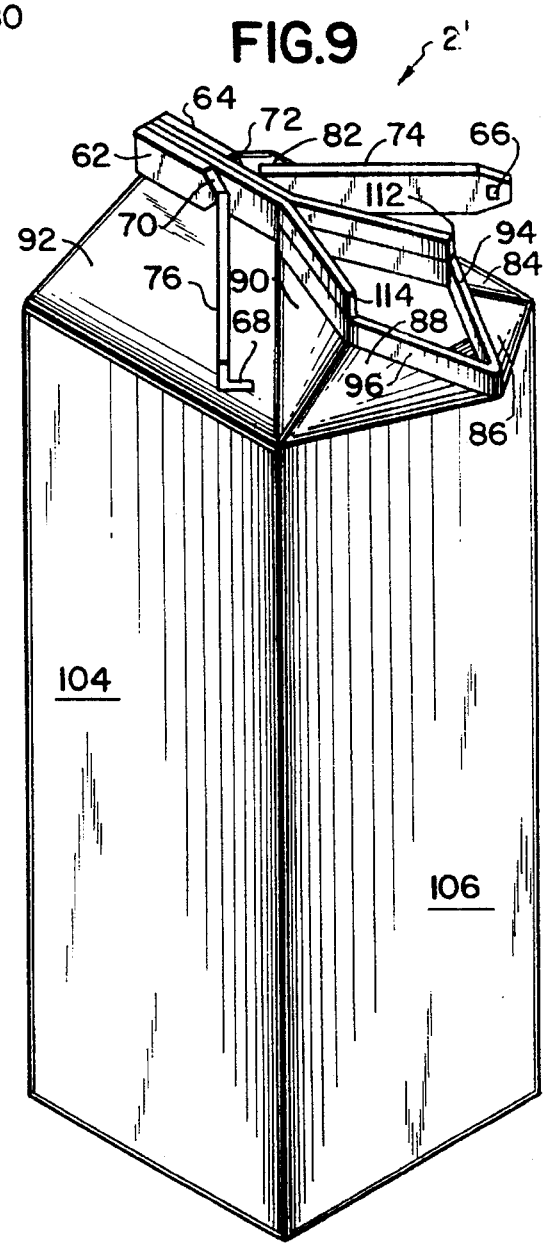

CLOSURE CLASP FOR A GABLE-TOPPED FOOD CARTON

BACKGROUND OF THE INVENTION

1. Field of the Invention

Relates to gable top carton closures and especially those for the cartons for packaging and dispensing fluid/liquid food products through the pour spout formed when the common gable top container is unsealed and the closure clasp manipulated to the open position. The food cartons herein are conventionally made from flat forms with the surfaces coated with a plastic, such as polyethylene. This provides additional strength and makes the carton impervious to penetration by liquids carried in the carton. It also serves to protect its contents from outside pollutants.

While such gable topped containers are widely used to generally securely and safely store the food contents before sale they are often difficult to open. The folds of the gable top which are used to form a spout are often ripped and/or damaged by the user in an attempt to spread the folds during the initial opening of the container. Consequently the pour spout many times is either partially or totally destroyed resulting in spillage and/or awkwardness while pouring the contents of the carton. In addition, once opened, the gable top may be folded back for closure, but the closure is not tightly sealed and consequently the contents, over a period of time, have a tendency to spoil or absorb noxious odors from surrounding foods in the typical household refrigerator. If the container is accidentally knocked over the contents are spilled over other items stored in the refrigerator and the liquid may drip down over other shelves of the refrigerator, forming a general mess which requires a time consuming any annoying clean up.

2. Prior Art

In U.S. Pat. No. 4,619,398 LARAMIE a closure sealer for gable top cartons with spaced walls is shown which comprises a plastic sealer which is formed with parallel walls that is slid across the top of the gable carton after opening in order to force the spout folds of the top against each other to ensure sealing. It is an item separate and apart from, and not attached to, the gable topped container itself. It therefore must be found each time it is desired to use it in connection with a carton. Further, as a practical matter in the normal household a multitude of these closures would have to be kept on hand because of the multitude of gable topped containers used in the average household. In addition, due to human nature, there would be a tendency for such closures to be accidentally disposed of along with the used container.

U.S. Pat. No. 4,830,273 KALBERER et. al., shows a gable topped container having a spout installed on the slanted panel of one side of the gable top. It is adhesively secured to one of the slanted upper surfaces surrounding an opening with reinforcing material secured to the container.

SUMMARY OF THE INVENTION

In accordance with the present invention there is provided a closure device for a gable top food container consisting of a pair of plastic strips adhered to the lateral sides of the gable top. These strips, when secured to the top, aid in the opening of the gable top. When closing, the opposed ends the strips may be snapped together forcing the folds of the spout opening to fold tightly against each other forming a tight secured seal which may be easily opened and closed any number of times until the contents of the package are exhausted. The strips are secured to the container material during the forming of the container blank by heat seal means. Reinforcing materials such as disclosed in U.S. Pat. No. 4,830,273 may be employed to add greater strength. Because it is firmly and permanently secured to the carton, when the strips are unclasped and spread apart the opening spout gable folds are easily separated, the clasp strips providing leverage assistance to separate the folds. The strips are formed by molding a polyethylene or inexpensive plastic and securing them to the container without adding any significant cost to the container.

The primary form envisions the strips secured with a first end midway along the folding section of the gable top with the second or other end extending slightly beyond the outer folded spout edge of the gable top with snap means at that end to be secured to each other.

In an alternate embodiment the strips may be sealed all along the gable or parallel sides of the gable top and be articulated in the center where the spout folds are separated.

BRIEF DESCRIPTION OF THE DRAWING

In the accompanying drawing which forms a part of this specification:

FIG. 5 is a perspective view of a previously opened container according to the present invention laying on its side with the gable top reclosed;

FIG. 6 is a similar view of a prior art container previously opened container laying on its' side illustrating how the gable closure tends to spread open causing the contents to spill or escape;

FIG. 8 is a perspective view from the front side quarter of the closed container incorporating the alternative closure clasp embodiment of the present invention;

FIG. 9 is a similar perspective view showing the closure opened.

ILLUSTRATIVE SPECIFIC EMBODIMENT

Figure 1:
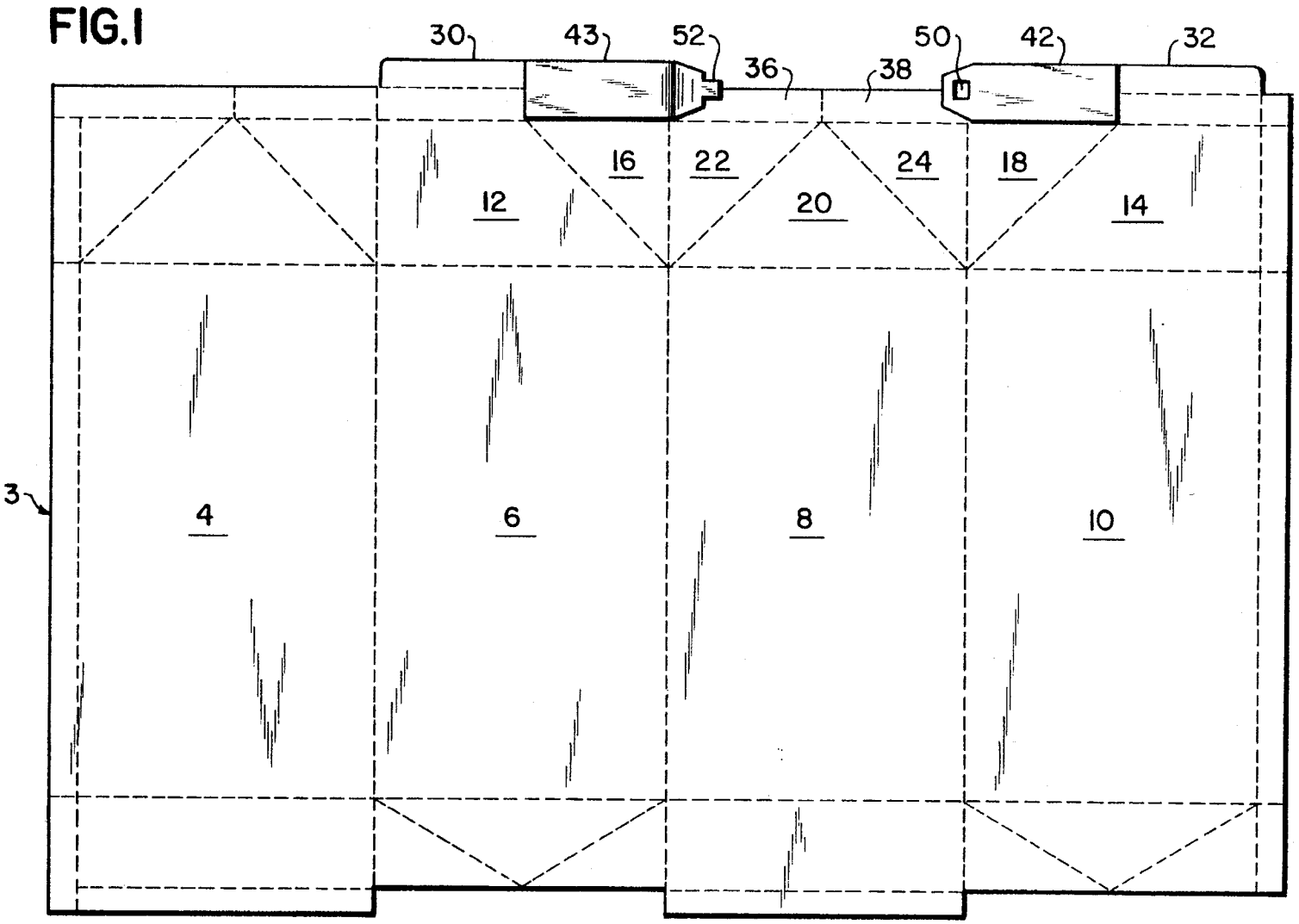
FIG. 1 is a plan view of a gable topped milk container blank incorporating one embodiment of the invention of the present application.
Figure 2:
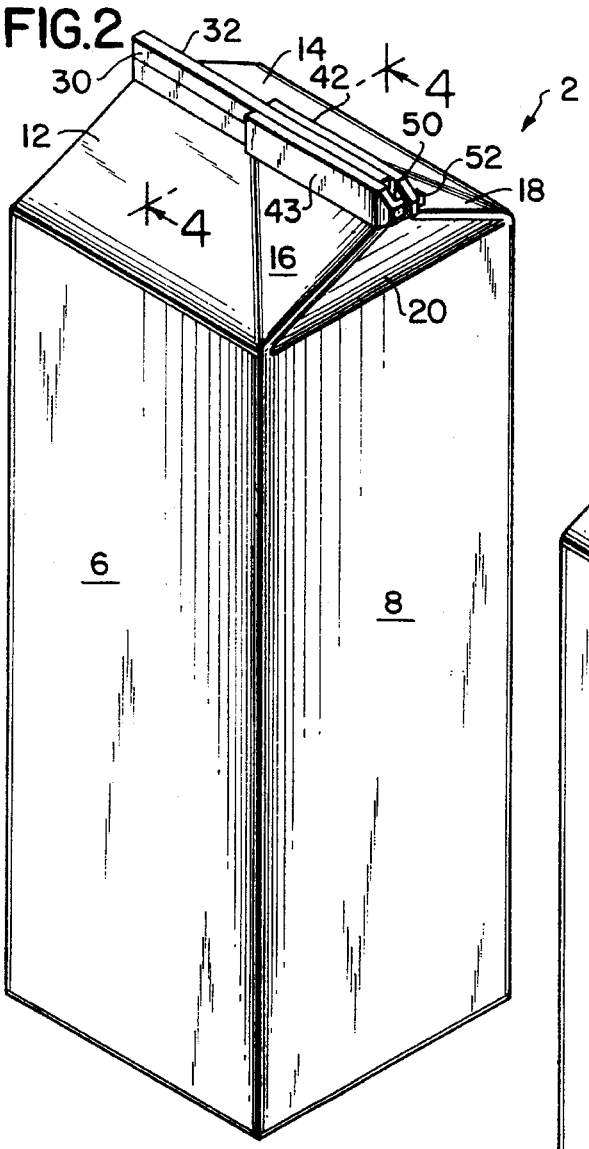
FIG. 2 is a perspective from the front and side quarter an assembled milk container with gable closure with the closure in a closed position according to the present invention.
Figure 3:
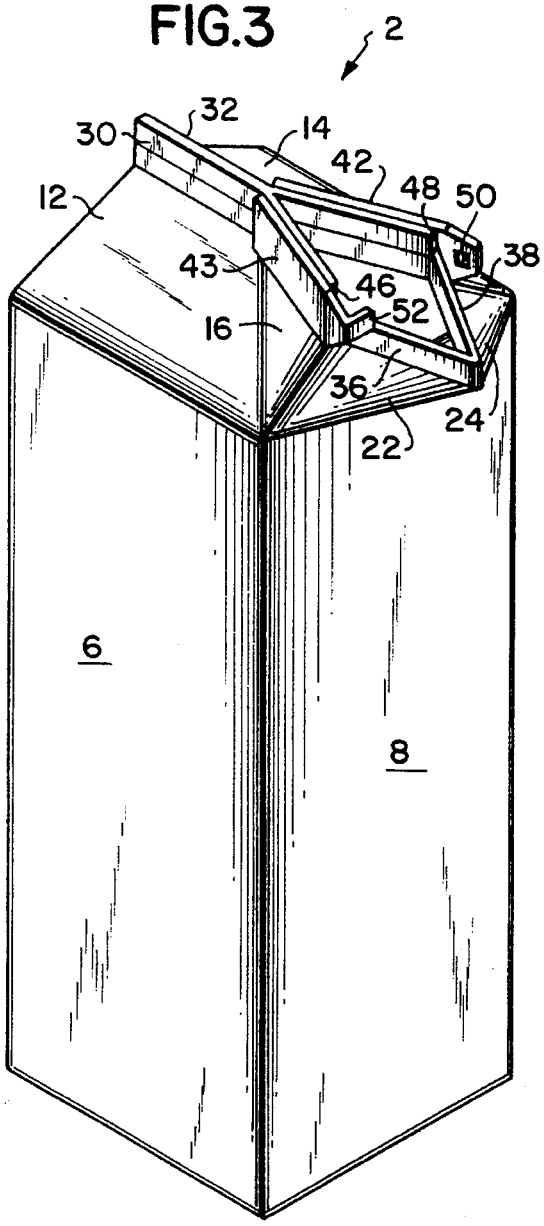
FIG. 3 is a perspective view of the front quarter of the assembled milk container with the spout thereof opened, incorporating the invention of the present application.
Figure 4:
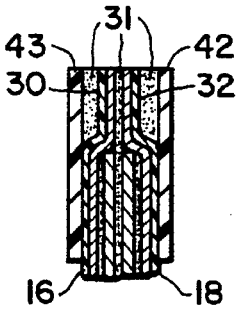
FIG. 4 is a sectional view of the carton shown in FIG. 2 taken along lines 4—4 FIG. 2.

In the accompanying drawing a typical milk carton 2 formed from blank 3 having shown in FIG. 1–3 a gable roof closure. The dotted liens indicate fold lines utilized in the assembly of the carton which is heat sealed and/or glued together. The panels of the device generally include a rear panel 4, right side panel 6, front panel 8, and left side panel 10.

The top portion of the carton 3 includes gable sides 12 and 14 having the forward portions 16 and 18 respectively forming a portion of the spout. The upper ridge portions 30 and 32 of the gable sides 12 and 14 are formed together in the conventional manner and portions 16 and 18 of the flaps formed thereby are pulled apart and unfolded forwardly to form the spout. The spout recess 20 with flaps 16 and 18 of spout forward sides 22 and 24 respectively are joined to the forward portions 16 and 18 of the gable sides 12 and 14 respectively to form the spout when reversed and folded open in the conventional manner as shown in FIG. 3.

In practice however, it is often difficult for the user to separate the folds 16 and 22, and 18 and 24 at flaps 36 and 38 without ripping some portions of the folds.

In accordance with the present invention, the closure device 25 on the outside of the fold formation is adhered to it by adhesive 31. The strips 42 and 43 respectively of polyethylene each of which is adhered to the front part of the upper ridge flaps 30 and 32, strips 42 and 43 extend slightly beyond the forward edges 46 and 48 of the ridges 30 and 32 as shown in FIG. 3.

One strip 42, has a rectangular aperture 50 formed therein and the other side strip 43 is formed with a rectangular key or tab 52 facing aperture 50 which when the spout is in the closed position of FIG. 3 firmly within the aperture 50.

Preferably the sides of the key 52 are tapered for snap closure. When the two plastic strip arms 42 and 43 are closed together the folds 16 and 22, and 18 and 24 are firmly held against each other, leakage is prevented and the closure securely sealed against contamination.

As shown in FIG. 5 a previously opened carton 2 equipped with the closure device 25 of the present invention that is snapped closed may be upset without any leakage as opposed to the case of the prior art the container of FIG. 6 without the device 25 of the present invention which when tilted over allows liquid 56 to escape.

Figure 7:
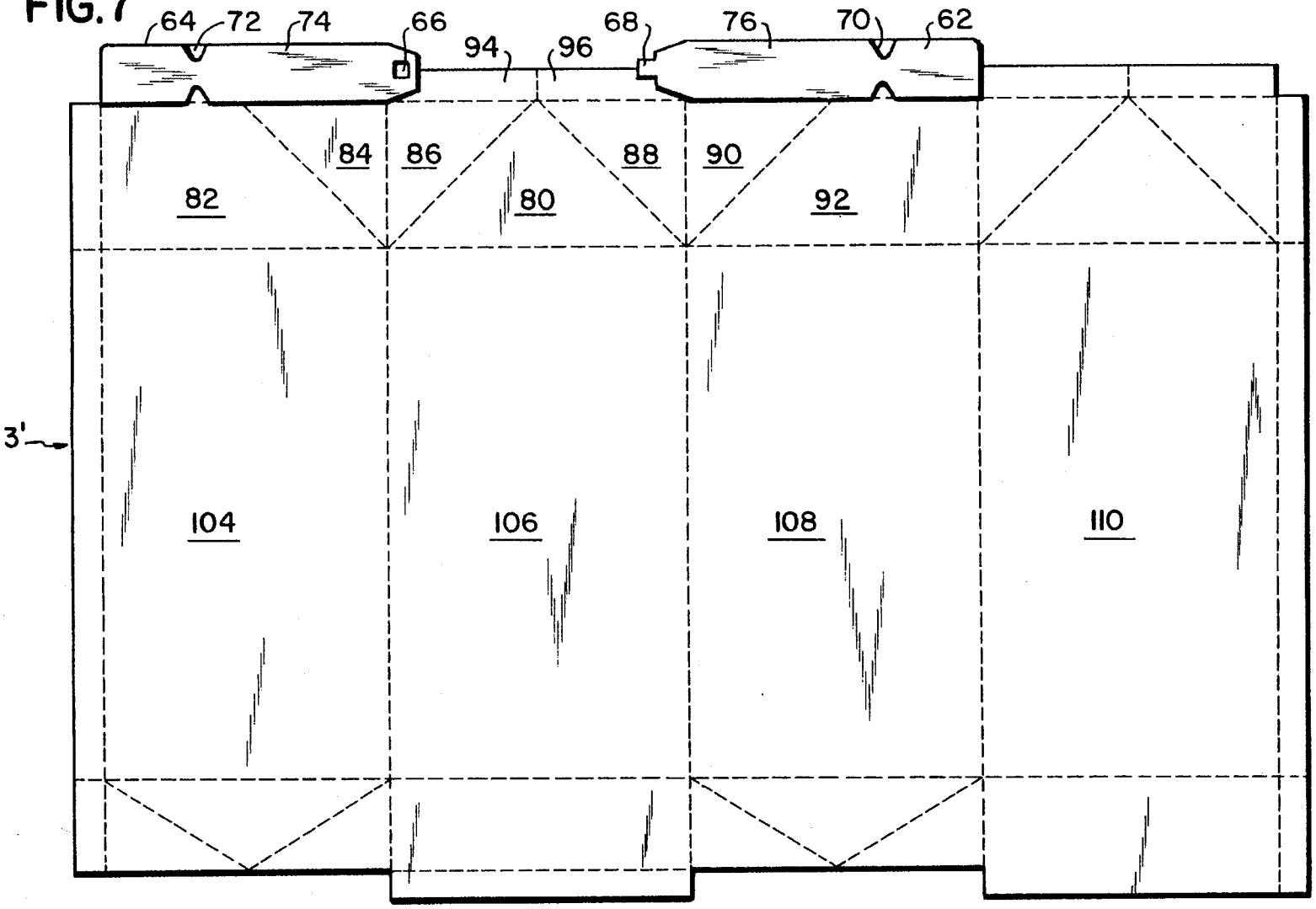
FIG. 7 is a plain view of a milk container blank incorporating alternate embodiment of the present invention.

An alternate embodiment shown in FIGS. 7 through 9 incorporates extended closure strips 62 and 64 adhered along the full length of the top ridges of the container blank 3'. They extend slightly beyond ends 112 and 114 of the top ridges. As shown in FIG. 7, the container blank 3' includes a right side panel 104, front panel 106, left side panel 108, and a rear panel 110. Gable sides 82 and 92 include forward sections 84 and 90, respectively, which in conjunction with the sections 86 and 88 on the front panel form the folded spout together with the spout recess 80. Closure strips 62 and 64 are notched at intermediate 70 and 72 so they may easily fold out as shown in FIG. 9. The strips 62 and 64 forward portions 74 and 76 are separated to open the carton 2' as shown in FIG. 9. The aperture 66 of strip portion 74 receives the key tab 68 of strip portion 76 to close the carton 2' as shown in FIG. 8, pressing folds 84 and 86, and 88 and 90 firmly against each other. The flaps or tabs of the front part of the spout and secured together. As indicated, the strips 62 and 64 are notched at mid-points 70 and 72 so they may be readily articulated laterally when unclasped to bend out and be closed together.

While the invention has been described by reference to an illustrative embodiment, it is not intended that the novel device be limited thereby, but that modifications thereof are intended to be included as falling within the broad spirit and scope of the foregoing disclosure, the following claims and the appended drawings.

What is claimed is:

1. A closure clasp device for a gable topped food carton wherein said carton has a pour spout, spout folds, said folds having outer edges, and folded flaps forming a gable top with a vertical ridge, said outer edges of said spout of said gable top having strips of plastic permanently secured laterally to said folded flaps, outer ends of said strips opposed to each other, said outer ends of said strips having snap together means for resealably securing said outer ends of said strips to each other, thereby sealing said spout shut.

2. A closure clasp as claimed in claim 1 wherein said strips extend from midpoint along said ridge to slightly beyond the spout edge of said top.

3. A closure clasp as claimed in claim 1 wherein said strips extend to the full length of said gable top and are articulated at mid point so as to allow opening and closing of said pour spout of said carton.

4. A closure clasp as claimed in claim 1 wherein said snap together means comprise an aperture in said outer end of one of said strips dimensioned to receive a key protuberance on said outer end of the other of said strips, said protuberance extending laterally toward said aperture from said end of said other strip, and when said strips are pressed towards each other, said aperture receives said key protuberance in snap releasable engagement.

* * * * *